United States Patent [19]

Houck et al.

[11] 4,020,719

[45] May 3, 1977

[54] SECURING A COUPLING TO A HOSE

[75] Inventors: Stanley J. Houck, Akron; Michael W. Smith, Mogadore, both of Ohio

[73] Assignee: The Goodyear Tire & Rubber Company, Akron, Ohio

[22] Filed: May 19, 1976

[21] Appl. No.: 687,776

[52] U.S. Cl. ..... 81/9.3; 29/237
[51] Int. Cl.[2] ..... B25B 27/10
[58] Field of Search ..... 29/237; 81/9.3; 140/123.5

[56] References Cited

UNITED STATES PATENTS

| | | | |
|---|---|---|---|
| 2,871,738 | 2/1959 | Abbiati | 81/9.3 |
| 3,027,788 | 4/1962 | Ott et al. | 81/9.3 |
| 3,596,686 | 8/1971 | Blumenfeld | 81/9.3 |

*Primary Examiner*—James L. Jones, Jr.
*Attorney, Agent, or Firm*—F. W. Brunner; R. S. Washburn

[57] ABSTRACT

Method and apparatus for applying a permanent clamp to secure a hose end to a hose coupling provide for equalizing the radial forces between the clamp and the hose and for deforming part of a strap or wire clamp to lock its open free end to its loop or closed end.

3 Claims, 5 Drawing Figures

SECURING A COUPLING TO A HOSE

This invention relates to hose and hose couplings, particularly to attaching a coupling to an end of high pressure heavy-duty flexible hose.

The object of the invention is to provide a method and an apparatus for securing permanently a hose end to a hose coupling.

Broadly, the method according to the invention comprises applying a clamp for securing an end of hose to a hose coupling, which clamp has a loop end and a free end, the free end being placed through the loop end to form a ring, the method comprising placing the ring about the hose end, inserting the coupling in the hose end, and characterized by engaging a hook in said loop end, gripping said free end and exerting tension in said clamp, rolling said ring with the hose end and coupling therein toward said free end and toward said loop end to distribute pressure between the ring and the hose end around the latter, then rotating said hose end and said ring around said loop end to secure said free end to said loop end without releasing tension in said clamp.

Broadly, according to the invention, the apparatus for applying a clamp for securing an end of hose to a hose coupling, which clamp has a loop end and a free end, the free end being placed through the loop end to form a ring, the apparatus comprising a frame, tensioning means including a support arm, an air cylinder and an anchor hook fixed on the arm, the cylinder having a grip movable toward and away from the hook, pivot means connecting the support arm pivotably to the frame, mounting means including an arbor for supporting a coupling and hose end having said ring disposed therearound with the loop end engaging the hook and the free end held by the grip, cam and cam track means on the frame operable to move the mounting means normal to the arbor to roll the clamp ring with the coupling and hose end therein toward its free end and toward its loop end while the tensioning means exerts tension in the clamp between the respective ends, and means for securing the free end and the loop end to each other around the hose end while the tensioning means exerts tension in the clamp.

To acquaint persons skilled in the arts most closely related to the present invention, certain preferred embodiments thereof illustrating a best mode now contemplated for putting the invention into practice are described herein by and with reference to the annexed drawings forming a part of the specification. The embodiments shown and described herein are illustrative and as will become apparent to those skilled in these arts can be modified in numerous ways within the spirit and scope of the invention defined in the claims hereof.

Figure 1:
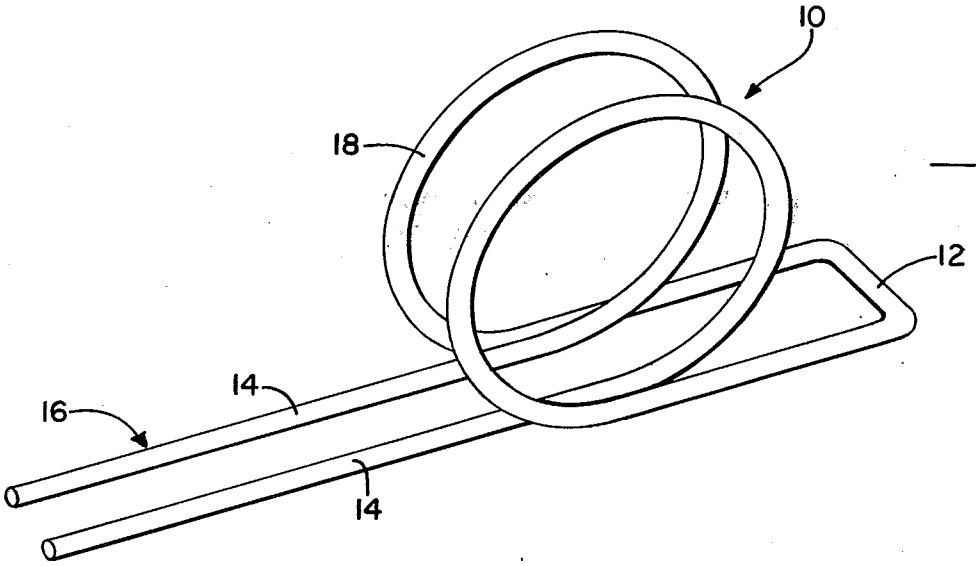
FIG. 1 PRIOR ART
FIG. 1 is an illustration in perspective of a clamp, the application of which is the subject of the present invention. The clamp of FIG. 1 is prior art.
Figure 2:
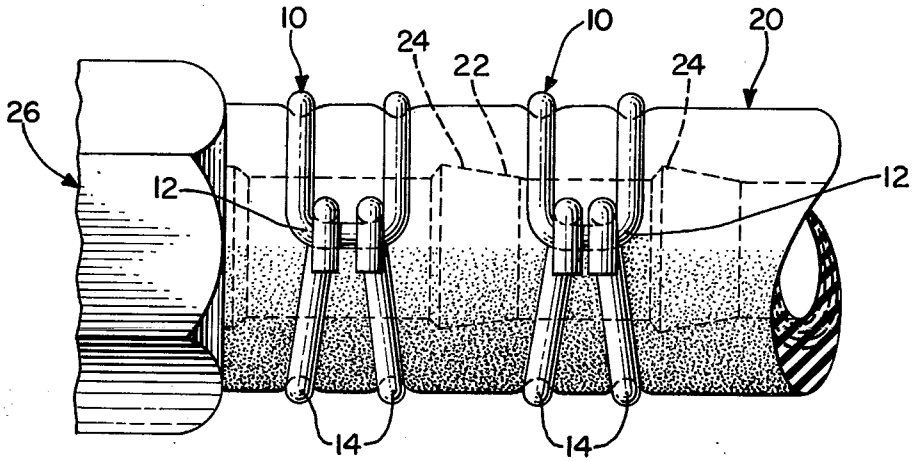
FIG. 2 PRIOR ART
FIG. 2 is a view of a coupling and hose end having clamps of FIG. 1 applied thereon. The hose, the coupling, and the clamps of FIG. 2 are prior art.

The hose clamp 10 illustrated in FIG. 1 is formed of a single length of wire which is bent, hairpin fashion, at approximately its mid-length to form a closed loop end 12 from which the two legs 14 extend parallel forming a free end 16. The legs are turned to form a ring 18 of a diameter slightly greater than the diameter of the hose end 20, FIG. 2, to which it is applied. The parallel legs of the clamp form a strap which is tensioned tightly about the hose to compress the hose end radially. The legs are passed through the loop formed in the closed end 12 and are there clamped or bent snugly about the wire of the loop to effect a permanent securement between the hose end 20 and the coupling nipple 22. The nipple is provided with enlarged portions 24, sometimes called barbs, which cooperate with the clamps 10 to secure the hose end from being pulled off the coupling 26. FIG. 2 illustrates a pair of clamps 10 applied to the hose end 20 and coupling 26. A single clamp can be used and two clamps are normally found sufficient for severe service. Both the clamp and the assembled coupling, hose end, and clamps are known and do not themselves come within the scope of the present invention.

After the clamp, or clamps, FIG. 1, has or have been placed loosely about the hose end, the coupling nipple 22 is inserted in the hose end in the usual manner. Then the looped end 12 and the free end of the clamp are pulled to create tension in the clamp and reduce the diameter of the ring 18.

In accordance with the present invention, distributing the pressure exerted between the hose end 20 and the clamp 10 more uniformly around the hose end, is accomplished by rolling the ring 18 of the clamp toward the loop end 12 and toward the free end 16 while the tension is maintained, or progressively increased, in the clamp. Then the ring is rolled to and beyond the loop end of the clamp, the tension in the clamp being maintained, and rotated around by the loop end thereby deforming the free end of the clamp around the wire of the loop end to form the permanent securement of the free end to the loop end without releasing the tension in the clamp. Any excess length of the free end legs can then be cut off to a suitable length as illustrated in FIG. 2.

The method described and in particular the step of rolling the ring of the clamp as described tends less to distort the material of the hose circumferentially of itself as the clamp and hose are increasingly pressed toward one another by the tension applied in the clamp than results in the hose when the clamp is applied without the rolling step.

Figure 3:
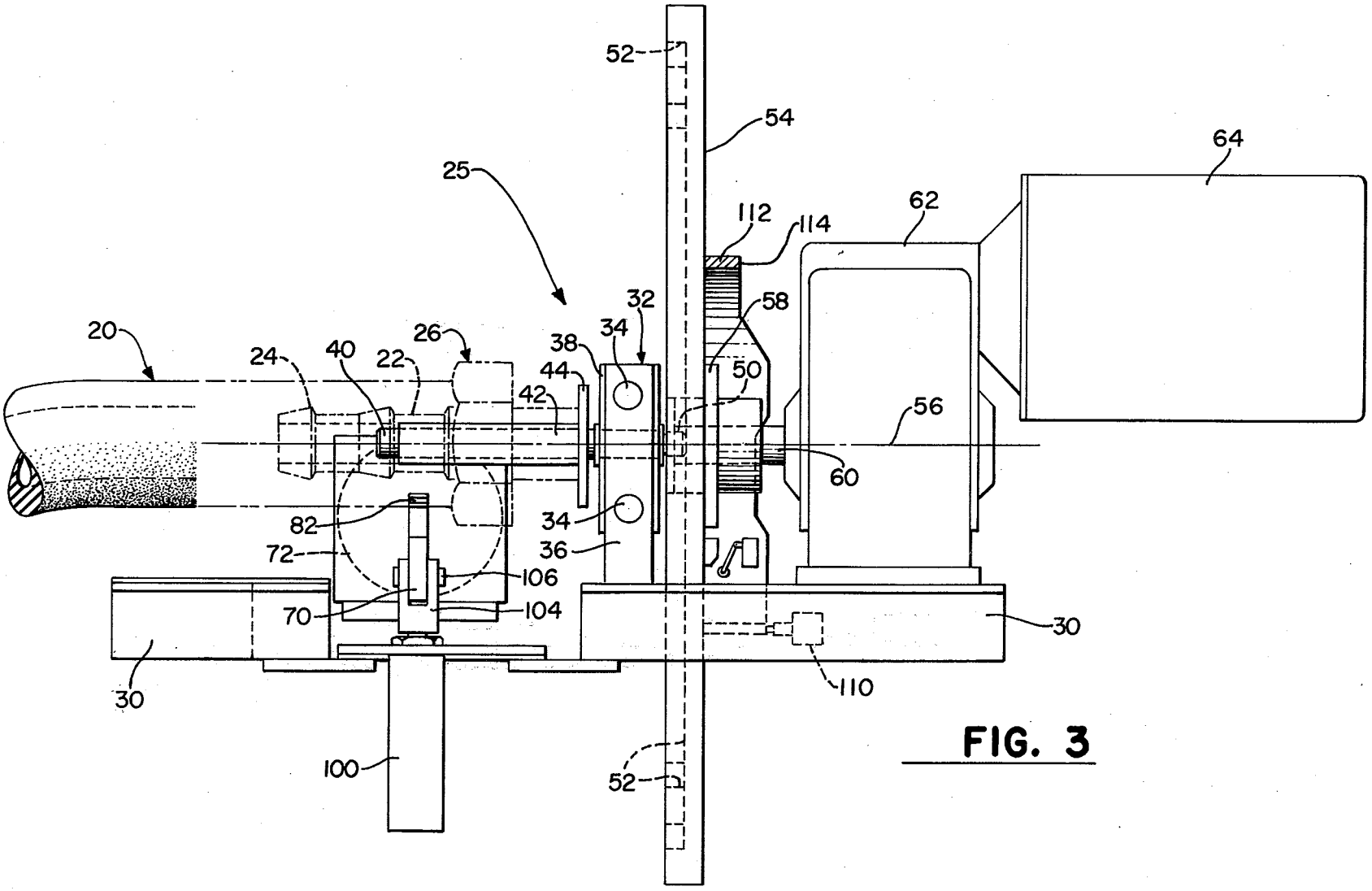
FIG. 3 is a view in side elevation of an apparatus in accordance with the invention.
Figure 4:
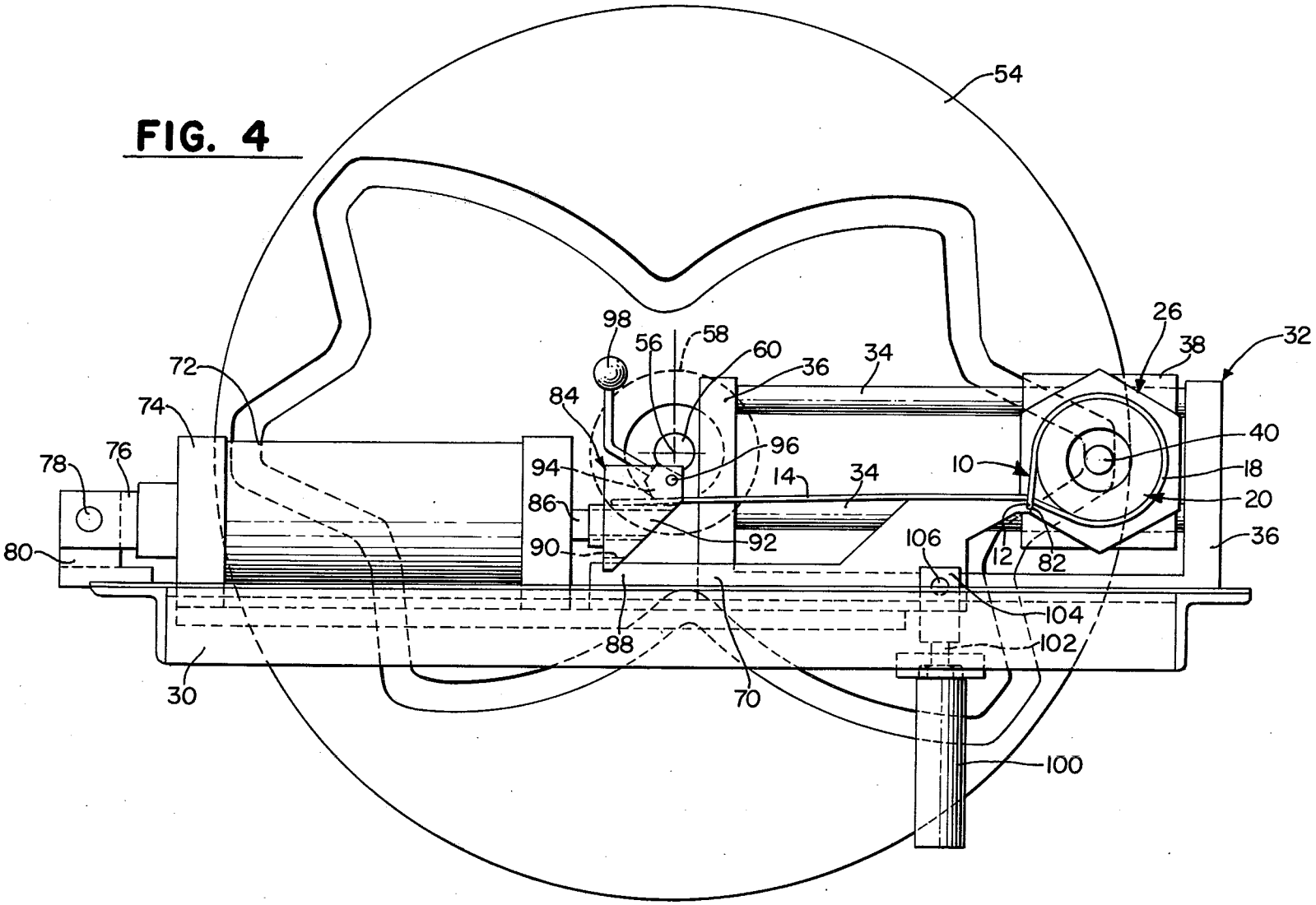
FIG. 4 is a view in front elevation of the apparatus of FIG. 3.

To carry out the method described, an apparatus 25 in accordance with the invention, referring to FIGS. 3 and 4, comprises a frame 30 having a slide 32 fixed thereon. The slide comprises a pair of parallel guide rods 34 secured to and extending between a pair of uprights 36. A crosshead 38 is mounted slidably on the guide rods. A stub arbor 40 is mounted in the crosshead, preferably by conventional anti-friction bearings and extends outward from the crosshead to support a coupling 26 and hose end 20. A bushing 42, which may have a flange 44, can be used to adapt the arbor to particular coupling size. The flange can be altered in thickness to locate the clamp axially of the coupling. The remaining length of hose can be accommodated in any suitable manner to permit freedom to rotate about its own longitudinal axis. The arbor, crosshead, and slide provide mounting means for supporting a coupling and hose end while a clamp ring disposed therearound is applied in accordance with the invention.

A cam follower 50 disposed on the crosshead 38 to extend oppositely of the arbor 40, and preferably coaxial with the arbor, is received in a cam track 52 formed in the face of a circular plate 54. The track 52 varies in its radial distance from the axis 56 of the plate 54 so that rotation of the plate about that axis moves the crosshead toward and away from the axis along the slide rods 34.

The plate 54 is mounted corotatably on a flanged hub 58 which is corotatably mounted on the output shaft 60 of a gear reducer 62 fixed on the frame 30. The rotation of the plate is provided by a motor 64 which is directly connected to the gear reducer and its input shaft (not shown) to provide a constant speed of rotation to the plate at about 2½ rpm.

In the particular embodiment described, the cam track 52 is arranged to complete the movements of the crosshead 38 for application of one clamp in 180° of revolution. In the other one-half revolution of the plate, the cam track, in the apparatus, is a duplicate of the cam track of the first half revolution, thereby completing a clamp application in an identical manner during the second half revolution of the plate.

To apply the tension in the clamp 10, the apparatus 25 includes tensioning means comprising a support arm 70 attached rigidly to a tension cylinder 72 the head end 74 of which is mounted by a clevis 76 and pivot pin 78 to a bracket 80 fixed on the frame 30. The arrangement provides pivot means connecting the tensioning means pivotally to the frame. The tensioning means includes an anchoring hook 82 secured to the support arm 70 and a free end grip 84 secured on the piston rod 86 of the cylinder. A guide rail 88 formed as a part of the anchor structure accommodates a slot 90 in the grip which prevents its rotation about the axis of the cylinder as the piston rod extends or retracts the grip. The grip provides a fixed jaw 92. A swing wedge 94 provides the cooperating jaw which clamps the wire, strap or clamp free end 16 against the fixed jaw. The wedge 94 is mounted pivotally about a pin 96 received in the sides of the grip. A lever 98 fixed in the wedge provides for manual unlocking as well as an unbalancing moment tending to tighten the engagement of the wedge against the wire free end as the tension therein is increased.

To provide for securing the free end of the clamp to its loop end an air cylinder 100 mounted on the frame has its piston rod 102 connected by a clevis 104 and pin 106 to the arm 70 below the hook 82 such that operation of the cylinder 100 causes the tensioning means to pivot about its pivot means. The cylinder 100 provides lift means which cooperates with the cam track 52 and cam follower 50 to produce a compound movement of the clamp ring with the hose end and coupling therein so that the ring 18 is caused to rotate relatively of the hook 82 and about the loop end 12 of the clamp as a turning axis. This rotation of the clamp ring relative to the hook while the free end of the clamp remains under tension causes the free end legs of the clamp to be bent snugly about the wire forming the loop end.

Figure 5:
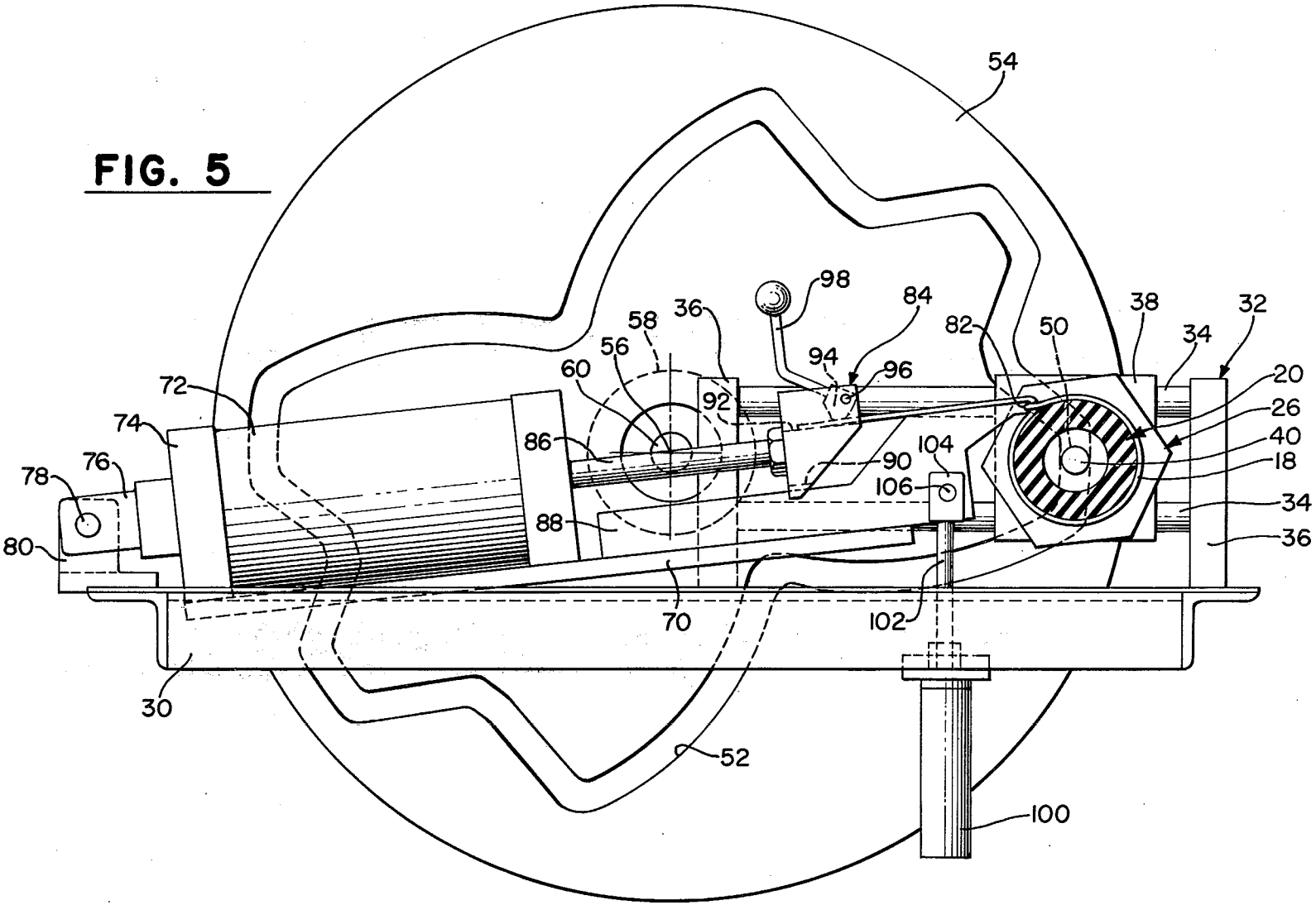
FIG. 5 is a schematic view in front elevation illustrating the operation of the apparatus of FIGS. 3 and 4.

The action of the lift means is better seen with reference to FIG. 5. As the arbor 40 and crosshead carrying the clamp ring are moved outward, toward the right in the figure, by the cam track in the rotating plate, the hook 82 is progressively elevated from the initial position to the final position. The cam track is such that the crosshead 38 moves the clamp ring first radially outwardly of the axis of the plate and then radially inwardly such that the clamp ring is positioned below and inward of the hook. After the securing bend in the free ends of the clamp is completed the excess length of the wires can be cut off by any suitable tool. Continued rotation of the disc then moves the crosshead radially outwardly and then, the hook being lowered, again inwardly to position the arbor at its starting position.

To control the air pressure applied to the tension cylinder, a commercial pressure regulator 110 is mounted on the frame to cooperate with an air valve control ring 112 which is attached coaxially to the circular plate opposite the cam track 52. The axial surface 114 of the ring is provided with steps, which can be graduated or sloped, and are measured from the plane of the disc. The steps are located at angular locations corresponding to the successive radial movements of the crosshead. The regulating valve is actuated in response to the steps along the surface 114 to control the air pressure supplied to the cylinder 72 as the plate 54 is rotated. The control ring 112 is in two parts and can readily be interchanged as required by different coupling-clamp combinations.

In the present embodiment the tension applied in the clamp as the crosshead moves toward the hook, to the right in FIG. 5, and initially toward the grip, toward the left in FIG. 5, by a pressure in the cylinder of 56 psi. is found satisfactory. When the crosshead reverses from its radially inward to its radially outward direction, the pressure in the cylinder then increased to about 62 psi.

In the particular clamp combination being described, a second clamp 10 is applied to the hose end 20 on the coupling and the cycle is repeated. In connection with the second clamp, and the second half rotation of the circular plate, the air valve control ring controls the air pressure to the cylinders at 74 psi and 79 psi, respectively, for the second clamp. The pressure values given are merely by way of example and are best determined by experiment with a particular clamp and a particular hose-coupling combination.

While certain representative embodiments and details have been shown for the purpose of illustrating the invention, it will be apparent to those skilled in the art that various changes and modifications may be made therein without departing from the spirit or scope of the invention.

What is claimed is:

1. Apparatus for applying a clamp for securing an end of hose to a hose coupling, which clamp has a loop end and a free end, the free end being placed through the loop end to form a ring, the apparatus comprising a crosshead having a cam track follower, an arbor mounted on the crosshead and extending outward therefrom to support the coupling and hose end thereon, a slide supporting the crosshead for movement perpendicular to the arbor, a circular plate mounted for rotation about an axis parallel to the arbor and having a cam track operable to move the follower and crosshead toward and away from said axis, tensioning means extending parallel to the plate having a hook engageable with the loop end, a grip engageable with the free end of the clamp and a cylinder operable to move the grip toward and away from the hook, lift means connected to the tensioning means and cooperable with the cam track to effect relative rotation of the coupling and hose end around the hook.

2. Apparatus as claimed in claim 1, including air pressure regulating means for controlling air pressure applied to said cylinder, and a cam ring mounted on said plate for actuating the regulating means.

3. Apparatus for applying a clamp for securing an end of hose to a hose coupling, which clamp has a loop end and a free end, the free end being placed through the loop end to form a ring, the apparatus comprising a frame, tensioning means including a support arm, an air cylinder and an anchor hook fixed on the arm, the cylinder having a grip movable toward and away from the hook, pivot means connecting the support arm pivotably to the frame, mounting means including an arbor for supporting a coupling and hose end having said ring disposed therearound with the loop end engaging the hook and the free end held by the grip, cam and cam track means on the frame operable to move the mounting means normal to the arbor to roll the clamp ring with the coupling and hose end therein toward its free end and toward its loop end while the tensioning means exerts tension in the clamp between the respective ends, and means for securing the free end and the loop end to each other around the hose end while the tensioning means exerts tension in the clamp.

* * * * *